US006216671B1

(12) United States Patent
Sawert et al.

(10) Patent No.: US 6,216,671 B1
(45) Date of Patent: Apr. 17, 2001

(54) MODULAR FUEL RESERVOIR FOR MOTOR VEHICLE

(75) Inventors: Ulf Sawert; Sharon Elizabeth Beyer, both of Grand Blanc; Dennis Paul McGrath, Ortonville; Dale Richard Jones, Flushing, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/447,074

(22) Filed: Nov. 22, 1999

(51) Int. Cl.[7] ..... F02M 37/04
(52) U.S. Cl. ..... 123/509; 123/497
(58) Field of Search ..... 123/509, 510, 123/495, 497

(56) References Cited

U.S. PATENT DOCUMENTS 5,642,718 * 7/1997 Nakai et al. ..... 123/509
5,647,330 * 7/1997 Sawert et al. ..... 123/509
5,785,032 * 7/1998 Yamashita et al. ..... 123/509
5,958,237 * 9/1999 Cort et al. ..... 123/509

* cited by examiner

*Primary Examiner*—Thomas N. Moulis
(74) *Attorney, Agent, or Firm*—Vincent A. Cichosz

(57) ABSTRACT

A modular fuel reservoir (MFR) including a cup-shaped plastic reservoir and a fuel pressure regulator supported on the reservoir. A fuel pump is supported in a tubular chamber of a retainer on top of the plastic reservoir and includes an exposed metal shell bearing against a wall of the tubular chamber and an electric motor turned on and off through a positive contact terminal and a negative contact terminal on a plastic end housing of the fuel pump. The retainer is made of an electrically conductive polymer and includes a resilient fin bearing against a metal housing of the pressure regulator. Ions stripped from the fuel and collected on the metal housing of the pressure regulator are conducted to the negative terminal on the end housing of the fuel pump through the electrically conductive retainer, the metal shell of the fuel pump, and an internal conductor in the fuel pump between the metal shell and the negative terminal. The wall of the tubular chamber on retainer constitutes a shield around the fuel pump which reduces radiated electrical emissions attributable to commutation in the electric motor of the fuel pump.

5 Claims, 2 Drawing Sheets

MODULAR FUEL RESERVOIR FOR MOTOR VEHICLE

TECHNICAL FIELD

This invention relates to a modular fuel reservoir in a motor vehicle fuel tank.

BACKGROUND OF THE INVENTION

A typical motor vehicle fuel system includes an element commonly referred to as a "modular fuel reservoir" (MFR) in a fuel tank of the motor vehicle. The MFR includes a tank cover, a cup-shaped plastic reservoir, a plurality of struts on the tank cover slidably connected to the reservoir, and a spring urging relative separation between the tank cover and the reservoir. The MFR is inserted into the fuel tank through an access port in the top of the fuel tank which is sealed closed by the tank cover. The spring biases the reservoir against the bottom of the fuel tank. A plastic retainer on the top of the plastic reservoir supports a fuel pump including an electric motor and a pump. The electric motor of the fuel pump is turned on and off through a wiring harness of the motor vehicle. When the electric motor is on, the pump pumps fuel at elevated pressure from the reservoir through a high pressure loop which includes a fuel rail of a fuel injection system of the motor vehicle and a fuel pressure regulator on the reservoir or on the retainer of the MFR. The pressure regulator releases fuel from the high pressure loop to the reservoir through a return loop and commonly includes a metal housing which is electrically insulated by the plastic reservoir or the plastic retainer and which, therefore, becomes a capacitor-like electrical storage device as ions stripped away from the fuel collect on the metal housing. To maintain the metal housing of the pressure regulator at the same potential as the negative terminal of the motor vehicle's battery, it is known to "ground" the metal housing through a terminal clip clipped onto the metal housing and a conductor attached to the terminal clip and spliced into a negative conductor of the wiring harness of the motor vehicle. Such extra wires and terminal clips, and the installation thereof, however, contribute to the manufacturing expense of the MFR.

SUMMARY OF THE INVENTION

This invention is a new and improved modular fuel reservoir (MFR) including a cup-shaped plastic reservoir, a tank cover, a plurality of struts on the tank cover slidably connected to the reservoir, a spring urging relative separation between the tank cover and the reservoir, and a pressure regulator supported on the reservoir. A fuel pump is supported in a tubular chamber of a retainer on top of the plastic reservoir and includes an exposed metal shell bearing against a wall of the tubular chamber and an electric motor turned on and off through a positive contact terminal and a negative contact terminal on a plastic end housing of the fuel pump. The retainer is made of an electrically conductive polymer having a surface resistivity less than or equal to $1\times10^3$ Ohms and/or a volumetric resistivity less than or equal to 600 Ohms/cm$^3$ as measured per ASTM D257 or equivalent test method and includes an integral resilient fin self-biased against a metal housing of the pressure regulator. Ions stripped from the fuel and collected on the metal housing of the pressure regulator are conducted to the negative terminal on the end housing of the fuel pump through the electrically conductive retainer, the exposed metal shell of the fuel pump, and an internal conductor in the fuel pump between the metal shell and the negative terminal.

The wall of the tubular chamber of the electrically conductive retainer constitutes a shield around the fuel pump which reduces radiated electrical emissions attributable to commutation in the electric motor of the fuel pump.

DESCRIPTION OF THE PREFERRED EMBODIMENT

Figure 1:
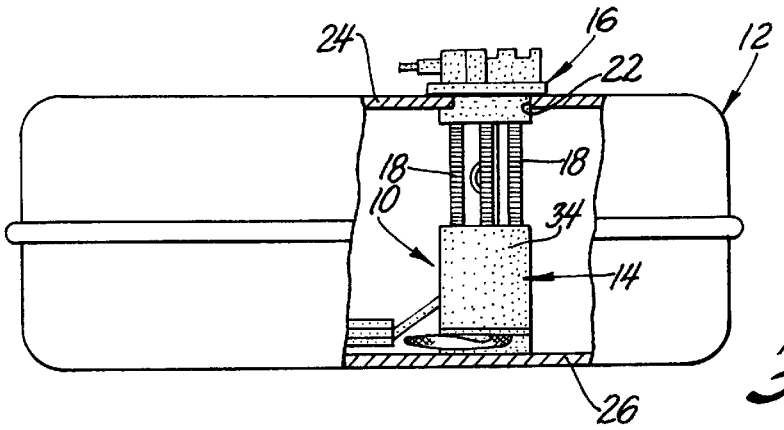
FIG. 1 is an elevational view of a modular fuel reservoir according to this invention in a motor vehicle fuel tank.
Figure 2:
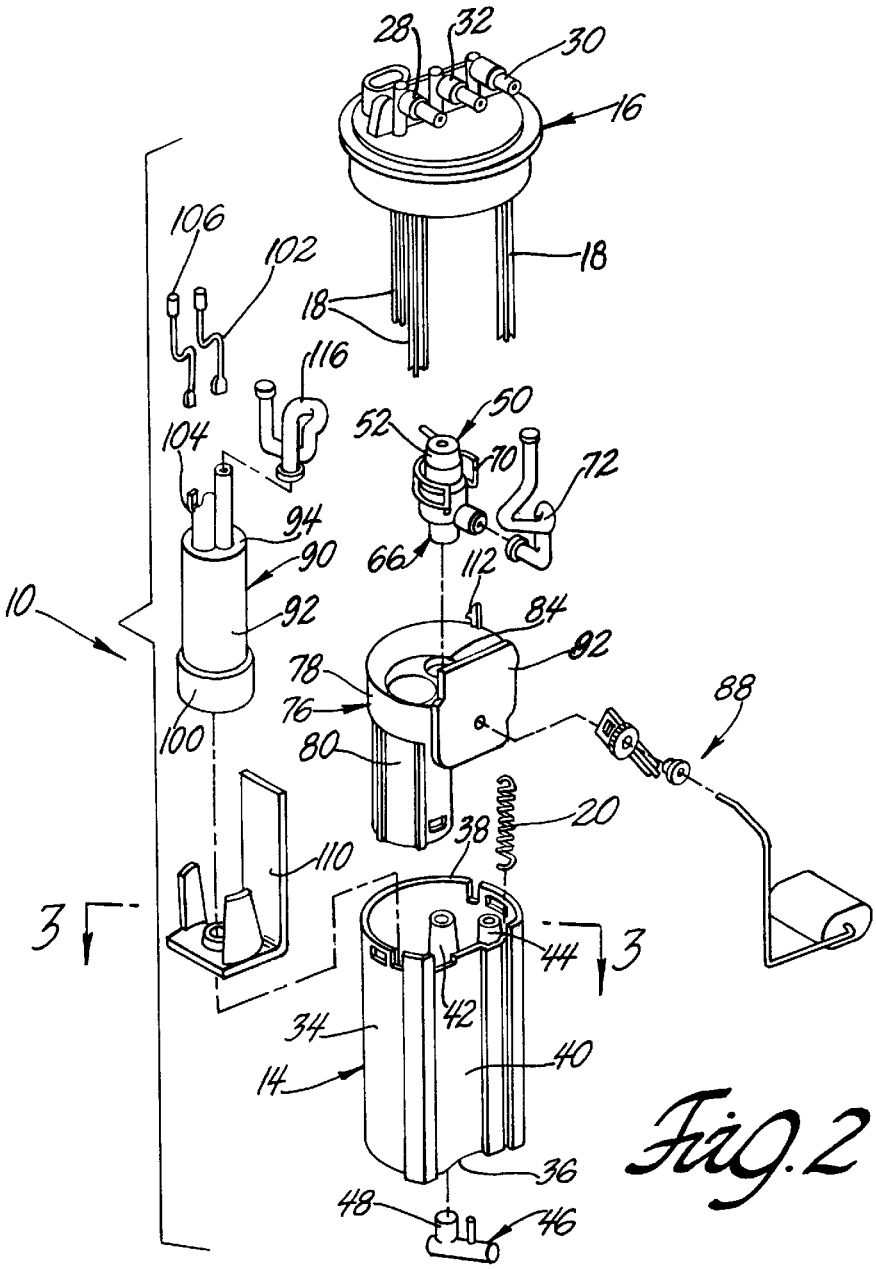
FIG. 2 is an exploded perspective view of the modular fuel reservoir according to this invention.

A seen best in FIGS. 1–2, a modular fuel reservoir (MFR) 10 according to this invention is disposed in a motor vehicle fuel tank 12 and includes a cup-shaped plastic reservoir 14, a tank cover 16, a plurality of vertical struts 18 on the tank cover slidably connected to the reservoir, and a spring 20 urging relative separation between the tank cover and the reservoir. The tank cover 16 seals closed an access port 22 in a top 24 of the fuel tank through which the MFR is inserted into the tank. The spring 20 biases the reservoir 14 against a bottom 26 of the fuel tank. A discharge fluid connector 28 and a return fluid connector 30 on the tank cover 16 are linked by external fluid conduits, not shown, to a fuel rail of a fuel injection system of the motor vehicle. A vapor connector 32 on the tank cover is linked by an external conduit, not shown, to a vapor storage device, not shown.

A cylindrical wall 34 of the reservoir 14 is closed by a bottom 36, open at a top edge 38 thereof, and flattened on a side 40. The reservoir has an integral vertical return tube 42 and an integral vertical fill tube 44 each open through the bottom 36 of the reservoir. A jet pump 46 below the bottom of the reservoir has an orifice, not shown, aimed at the fill tube 44 and a motive fluid inlet 48 connected to the return tube 42.

Figure 3:
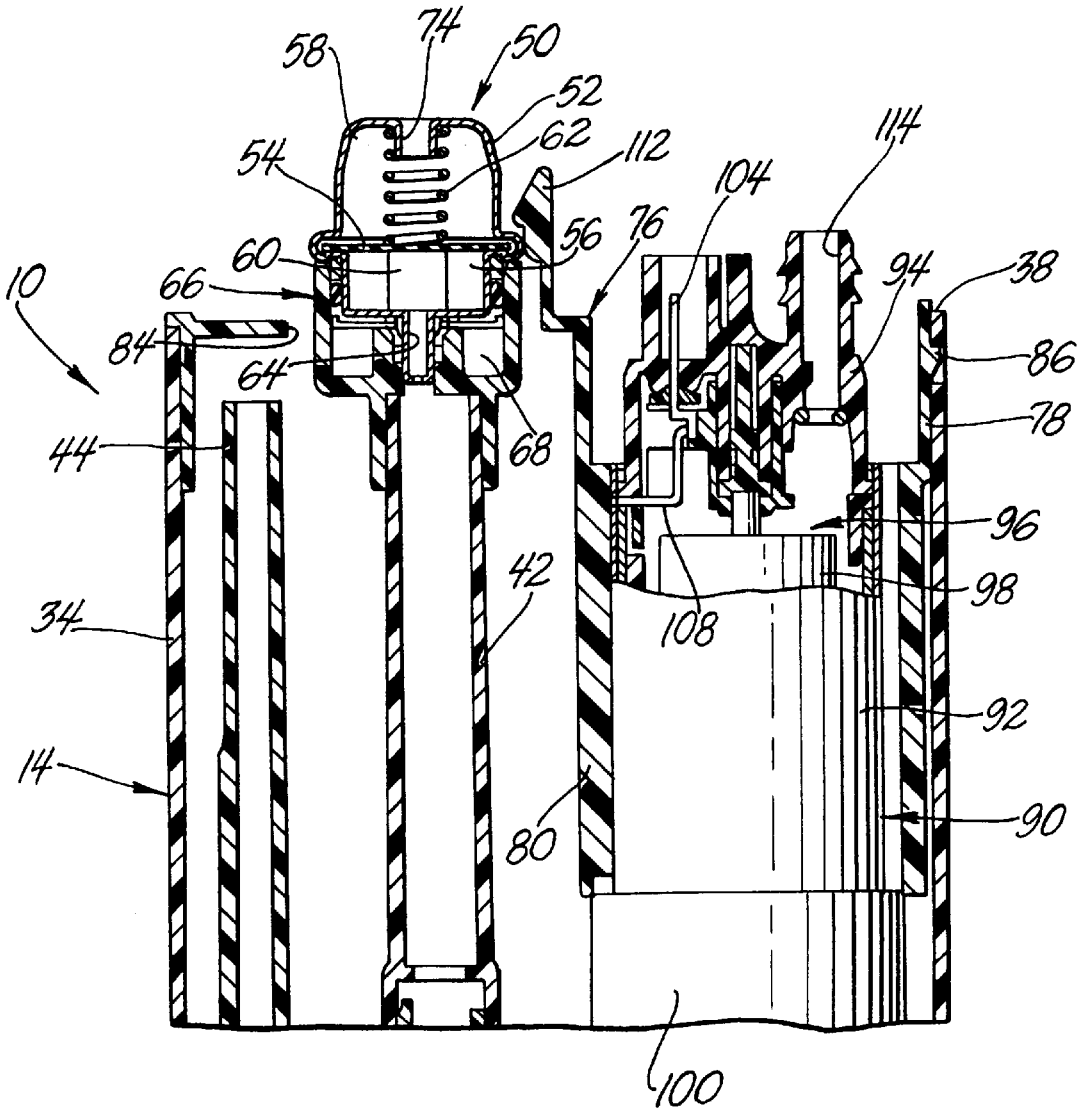
FIG. 3 is a fragmentary sectional view taken generally along the plane indicated by lines 3—3 in FIG. 2.

A fluid pressure regulator 50, FIGS. 2–3, of the MFR 10 includes a metal housing 52, an internal flexible diaphragm 54 dividing the metal housing into a pressure chamber 56 and a spring chamber 58, a valve element 60 on the flexible diaphragm, and a spring 62 in the spring chamber biasing the valve element 60 against the bottom of the metal housing 52 over a passage 64 in a stem of the metal housing. The metal housing 52 is seated in a plastic support 66 on top of the vertical return tube 42 on the reservoir and cooperates with the support in defining an annular chamber 68 below the metal housing in fluid communication with the pressure chamber 56 through orifices, not shown, in the metal housing. The pressure chamber 56 communicates with the motive fluid inlet 48 of the jet pump 46 through the passage 64 in the stem of the metal housing and through the return tube 42. Dislodgment of the metal housing 52 from the plastic support 66 is prevented by a metal clip 70. The annular chamber 68 communicates with the return fluid connector 30 on the tank cover through a flexible plastic hose 72. The spring chamber 58 is exposed to the pressure prevailing in the fuel tank through an aperture 74 in the metal housing 52.

A molded plastic retainer 76 of the MFR 10 includes a vertical side wall 78 matching the shape of the cylindrical wall 34 of the reservoir 14, a vertical tubular chamber 80, and a vertical mounting pad 82. The retainer 76 seats on and covers the reservoir 14 at the top edge 38 of the cylindrical wall 34 with the pressure regulator support 66 separated from the retainer by a clearance aperture 84 in the retainer. Dislodgment of the retainer 76 from the reservoir 14 is prevented by a plurality of barbs 86, FIG. 3, on the retainer which resiliently snap into sockets in the reservoir. A fuel level transducer 88 is mounted on the vertical mounting pad 82 and connected to a wiring harness, not shown, of the motor vehicle. Importantly, the retainer 76 is molded from an electrically conductive material such as Celcon EC90PLUS, an acetal copolymer available commercially from Ticona, having a surface resistivity less than or equal to $1\times10^3$ Ohms and/or a volumetric resistivity less than or equal to 600 Ohms/$cm^3$ as measured per ASTM D257 or equivalent test method.

A fuel pump 90 of the MFR 10 includes an exposed tubular shell 92 made of an electrically conductive material, e.g. steel or aluminum, an end housing 94 made of an electrically non-conductive material, e.g. plastic, closing an end of the metal shell, and an electric motor 96 in the metal shell. The electric motor 96 includes an armature 98 rotatable about a longitudinal centerline of the fuel pump and connected to an impeller, not shown, of a schematically represented pump 100 at the other end of the shell 92 from the end housing 94. A positive contact terminal, not shown, of the electric motor 96 on the end housing 94 is connected to the wiring harness of the motor vehicle through a positive conductor 102 between the fuel pump and the tank cover 16. A negative contact terminal 104 of the electric motor 96 on the end housing 94 is electrically insulated from the positive contact terminal and connected to the wiring harness of the motor vehicle through a negative conductor 106 between the fuel pump and the tank cover 16. The negative contact terminal 104 is in electrical communication with the metal shell 92 of the fuel pump through a schematically represented internal conductor 108, FIG. 3, in the fuel pump.

The fuel pump 90 is supported on the retainer 76 in the tubular chamber 80 thereof with the wall of tubular chamber surrounding and bearing directly against the metal shell of the fuel pump and establishing an electrically conductive interface between the metal shell the retainer. An inlet, not shown, of the pump 100 is exposed to the plastic reservoir 14 through a filter 110, FIG. 2, outside of the tubular chamber 80. A resiliently flexible, integral contact fin 112 on the retainer 76 is self-biased against the metal housing 52 of the pressure regulator to establish an electrically conductive interface between the metal housing and the retainer. The metal clip 70 securing the pressure regulator to the support 66 may also function as an electrical conductor between the metal housing 52 and the retainer 76. A discharge passage 114 on the end housing 94 of the fuel pump is connected to the discharge connector 28 on the tank cover 16 through a flexible plastic hose 116.

When the electric motor 96 of the fuel pump 90 is on, the armature 98 of the electric motor rotates the aforesaid pump impeller to pump fuel from the reservoir 14 to the high pressure loop through the discharge passage 114, the flexible hose 116, and the discharge connector 28 on the tank cover. Fuel in the high pressure loop circulates back to the pressure chamber 56 of the pressure regulator 50 through the return fluid connector 30 on the tank cover, the flexible hose 72, and the annular chamber 68 below the metal housing 52 of the pressure regulator. When the pressure force on the flexible diaphragm 54 exceeds the thrust of the spring 62, the valve element 60 separates from the bottom of the metal housing 52 to divert a fraction of the discharge of the fuel pump into the return tube 42 through the passage 64. The diverted fuel in the return tube enters the motive fluid inlet 48 of the jet pump and is discharged into the fill tube 44 as a jet which aspirates fuel from the fuel tank into the reservoir 14 to maintain the reservoir filled with fuel until the fuel tank is completely depleted.

When fuel is flowing in the high pressure loop and the return loop, the metal housing 52, which is electrically insulated by the plastic support 66, constitutes a charging-storing element of the MFR as ions stripped from the fuel collect on the metal housing. The ions which thus collect on the metal housing are conducted to the negative terminal 104 on the end housing 94 of the fuel pump through the retainer 76 in contact with the metal housing at the fin 112, the metal shell 92 of the fuel pump 90 in contact with the retainer at the wall of the tubular chamber 80, and the internal conductor 108 in the fuel pump. Since the negative terminal 104 is "grounded", i.e. connected to and maintained at the electrical potential of the negative terminal of a battery of the motor vehicle, through the aforesaid wiring harness, the ions which collect on the metal housing 52, or on any other metal element in contact with the retainer 76, are harmlessly conducted to the negative terminal of the battery without resort to external contact clips and wires characteristic of prior MFR's. In addition, because the wall of the tubular chamber 80 of the retainer 76 surrounds the electric motor 96 of the fuel pump and is likewise "grounded" through the metal shell 92 and the internal conductor 108, the wall of the tubular chamber constitutes a shield which reduces radiated electrical emissions attributable to commutation in the electric motor 96 for improved reception and transmission of radio equipment on the motor vehicle.

Having thus described the invention, what is claimed is:

1. A modular fuel reservoir comprising:

a cup-shaped plastic reservoir, an electrically conductive retainer covering an open end of the cup-shaped plastic reservoir, a fuel pump including an exposed shell made of an electrically conductive material and an end housing at an end of the exposed shell made of a electrically nonconductive material and an electric motor inside of the exposed shell, an electrical conductor inside of the fuel pump between the exposed shell and a negative contact terminal of the electric motor on the end housing, a mounting means operable to mount the fuel pump on the retainer with the exposed shell of the fuel pump having an electrically conductive interface with the retainer, a charge-storing element supported on one of the retainer and the cup-shaped plastic reservoir defining a capacitor-like electrical storage device for ions stripped away from fuel flowing in contact with the charge-storing element, and a contact means operable to form an electrically conductive interface between the retainer and the charge-storing element so that an electrically conductive flow path for the ions collected on the charge-storing element is defined through the retainer and the exposed shell of the fuel pump and the electrical conductor inside of the fuel pump to the negative contact terminal on the end housing of the fuel pump.

2. The modular fuel reservoir recited in claim 1 wherein:

the retainer is made of an electrically conductive plastic material having at least one of a surface resistivity less than or equal to $1\times10^3$ ohms and a volumetric resistivity less than or equal to 600 ohms/$cm^3$.

3. The modular fuel reservoir recited in claim 1 wherein the mounting means operable to mount the fuel pump on the retainer comprises:

a tubular chamber on the retainer having a wall surrounding and bearing directly against the exposed shell of the fuel pump to effect an electrically conductive interface with the exposed shell and to shield the fuel pump against radiated electrical emissions attributable to commutation in the electric motor in the fuel pump.

4. The modular fuel reservoir recited in claim 3 wherein the charge-storing element supported on one of the retainer and the cup-shaped plastic reservoir comprises:

a metal housing of a fuel pressure regulator supported on the plastic reservoir.

5. The modular fuel reservoir recited in claim 4 wherein the contact means comprises:

a resilient fin integral with the retainer and self-biased against the metal housing of the fuel pressure regulator.

* * * * *